US008100667B2

(12) United States Patent
Chivers et al.

(10) Patent No.: US 8,100,667 B2
(45) Date of Patent: Jan. 24, 2012

(54) TURBOMACHINERY DISC

(75) Inventors: Nigel J. D. Chivers, Chippenham (GB); Paul S. Topliss, Bristol (GB)

(73) Assignee: Rolls-Royce PLC, London (GB)

( * ) Notice: Subject to any disclaimer, the term of this patent is extended or adjusted under 35 U.S.C. 154(b) by 617 days.

(21) Appl. No.: 12/292,248

(22) Filed: Nov. 14, 2008

(65) Prior Publication Data

US 2009/0180891 A1 Jul. 16, 2009

(30) Foreign Application Priority Data

Jan. 16, 2008 (GB) ..... 0800705.6

(51) Int. Cl.
*F01D 5/02* (2006.01)

(52) U.S. Cl. ..... 416/248; 416/219 R

(58) Field of Classification Search ..... 416/244 A, 416/198 A, 248, 500, 219 R
See application file for complete search history.

(56) References Cited

U.S. PATENT DOCUMENTS

| | | | | |
|---|---|---|---|---|
| 4,310,286 | A * | 1/1982 | Peters et al. | 416/198 A |
| 5,029,439 | A | 7/1991 | Berneuil et al. | |
| 5,215,440 | A * | 6/1993 | Narayana et al. | 416/204 A |
| 5,579,644 | A | 12/1996 | Naudet | |
| 5,624,233 | A * | 4/1997 | King et al. | 416/219 R |
| 2005/0025625 | A1 | 2/2005 | Escure et al. | |

* cited by examiner

*Primary Examiner* — Seungsook Ham
(74) *Attorney, Agent, or Firm* — Oliff & Berridge PLC

(57) ABSTRACT

A turbomachinery disc, (e.g. a fan) has a primary axis of rotation and an axial flow direction X parallel to the primary axis of rotation. The disc has an annular diaphragm extending from proximate a blade land to a free inner radius. The diaphragm is asymmetrical about a plane (P) perpendicular to the primary axis of rotation.

7 Claims, 4 Drawing Sheets

Related art

Related art

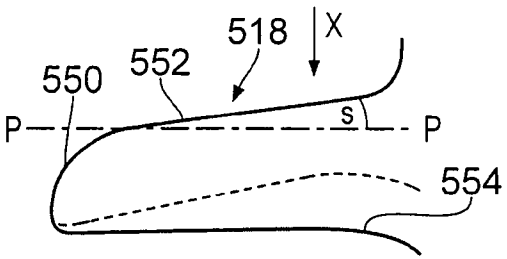
FIG. 4a
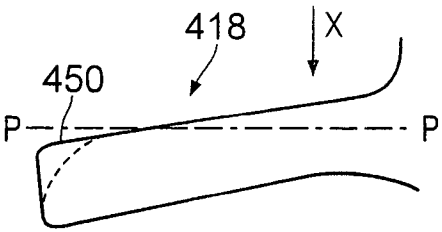
FIG. 4b
FIG. 4c
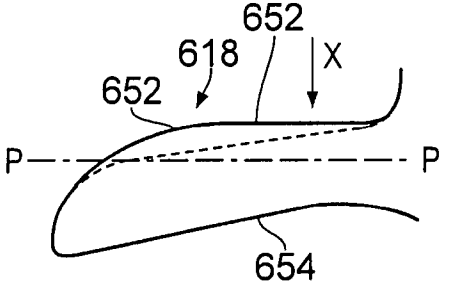
FIG. 4d
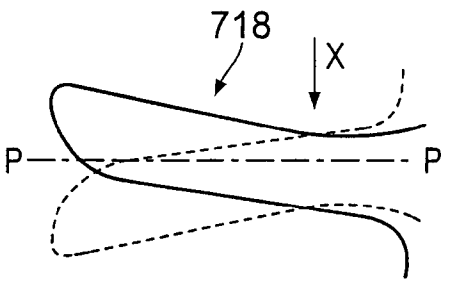
FIG. 4e
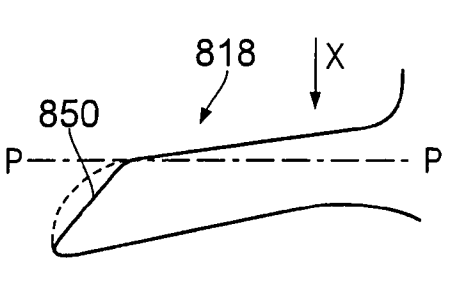
FIG. 4f
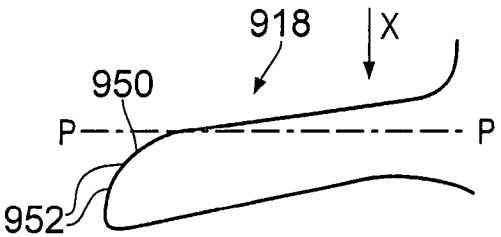
FIG. 4g

TURBOMACHINERY DISC

BACKGROUND

The present invention is concerned with rotating annular turbomachinery components. Specifically, the present invention is concerned with compressor discs of a gas turbine or an aero engine fan. By turbomachinery we mean machines that transfer energy between a rotor and a fluid, including turbines, fans and compressors.

When an annular component is rotated, various stresses are developed in the component as a result of the rotational motion. For example radial stresses are generated in the radial direction of the component as it rotates.

Hoop stresses are also generated in rotating annular components. The magnitude of hoop stress observed at a given radius in a rotating annular component is dependent on both the inner and outer radius of that component. Specifically, as either the inner or outer radius of the component is made larger, the hoop stresses generated at given radius will increase.

For an annular component with a given inner and outer radius however, the maximum hoop stress is observed at the inner radius, and reduces towards the outer radius.

As such, an annular component with a small inner radius has a lower maximum hoop stress than an annular component with a larger inner radius (providing the outer radius is the same).

SUMMARY

Turbomachinery such as fans and compressors for aerospace applications have a rotating component known as a disc. Discs typically include a rotationally symmetric body having a blade land. A plurality of circumferentially spaced aerofoil shaped blades are mounted to the blade land. Rotation of the disc at high speeds causes fluid to be drawn past the blades to compress the fluid (as used in compressors for gas turbine applications), or generate a thrust force on the component (as used in propulsive fan applications).

The high rotational speeds encountered by such components in use creates significant hoop stresses in the rotating disc, and as such the inner radius of such discs is commonly reduced by creating an annular component extending from the blade land to an inner radius. Such annular components are referred to as diaphragms, and commonly include an axially thin walled annular section projecting from the blade region terminating in an axially thicker section at the inner radius (creating what is commonly referred to as a "contoured disc").

As mentioned, the maximum hoop stresses in a rotating annular component occur at the inner radius. As such the axially thicker section of the diaphragm is designed to withstand these stresses, whereas the axially thinner section is designed to withstand radial stress and the smaller hoop stresses generated away from the inner radius.

There is a lower limit to the inner radius of such diaphragms. Other components such as shafts and gearboxes pass through the centre of the compressor or fan assembly and restrict the inner radius to a minimum threshold.

One problem with contoured discs is that in vertically oriented compressors and fans, they act as a "tub" and hold fluids such as water or oil. These fluids can cause out of balance loads which can cause significant stresses on the compressor or fan components, thus reducing the life of these components. As such it is often desirable to place orifices in the disc rim to allow the passage of fluids such as oil and water.

A problem with such orifices is that they are stress concentrations and will limit the life of the component. One solution to this problem is to cold expand highly stressed orifices, however this technique can cause damage to the component and as such is undesirable.

To remove the orifices altogether a slab-sided disc may be used, which comprises a diaphragm with constant thickness. As such, the thicker portion at the inner radius is removed and the "tub" effect is alleviated, as the fluid can drain away towards the inner radius.

The axial thickness of a slab sided disc needs to be such that the maximum hoop stress can be withstood at the inner radius. As such, a problem with slab sided discs is that they tend to be heavy as this thickness is substantial. Additionally, hoop stresses significantly decrease in the outward radial direction (there is a high stress gradient from the inner to the outer radius) which means that much of the material in the diaphragm away from the inner radius is unnecessary.

Slab sided discs are also used when there is a small space envelope for the diaphragm. In this situation the inner radius of the diaphragm is such that hoop stresses generated throughout the radial length are of such a level that a contoured diaphragm is not appropriate.

It is an aim of the exemplary embodiments of the present invention to alleviate one or more of the above problems.

According to the exemplary embodiments there is provided a fan, compressor or turbine disc.

A turbomachinery disc may have a disc body having a blade land defined thereon, the disc having a primary axis of rotation and an axial flow direction parallel to the primary axis of rotation. The disc may have a single annular diaphragm of constant axial thickness, extending from proximate the blade land to a free inner radius. The diaphragm may be asymmetrical about a plane perpendicular to the primary axis of rotation, in which the diaphragm defines a leading surface facing the axial flow direction. The leading surface may not bend or curve in an upstream direction opposite to the axial flow direction, and the leading surface may be angled towards the primary axis of rotation.

BRIEF DESCRIPTION OF THE DRAWINGS

An example fan disc in accordance with the exemplary embodiments will now be described with reference to the accompanying figures, in which:

FIG. 4*a* is a detail view of an axisymmetric section through the disc of FIG. 3;

FIG. 4*b* is a detail view of an axisymmetric section through a disc in accordance with a second embodiment of the present invention;

FIG. 4*c* is a detail view of an axisymmetric section through a disc in accordance with a third embodiment of the present invention;

FIG. 4*d* is a detail view of an axisymmetric section through a disc in accordance with a fourth embodiment of the present invention;

FIG. 4*e* is a detail view of an axisymmetric section through a disc in accordance with a fifth embodiment of the present invention;

FIG. 4*f* is a detail view of an axisymmetric section through a disc in accordance with a sixth embodiment of the present invention; and FIG. 4*g* is a detail view of an axisymmetric section through a disc in accordance with a seventh embodiment of the present invention.

DETAILED DESCRIPTION OF EMBODIMENTS

Figure 1:
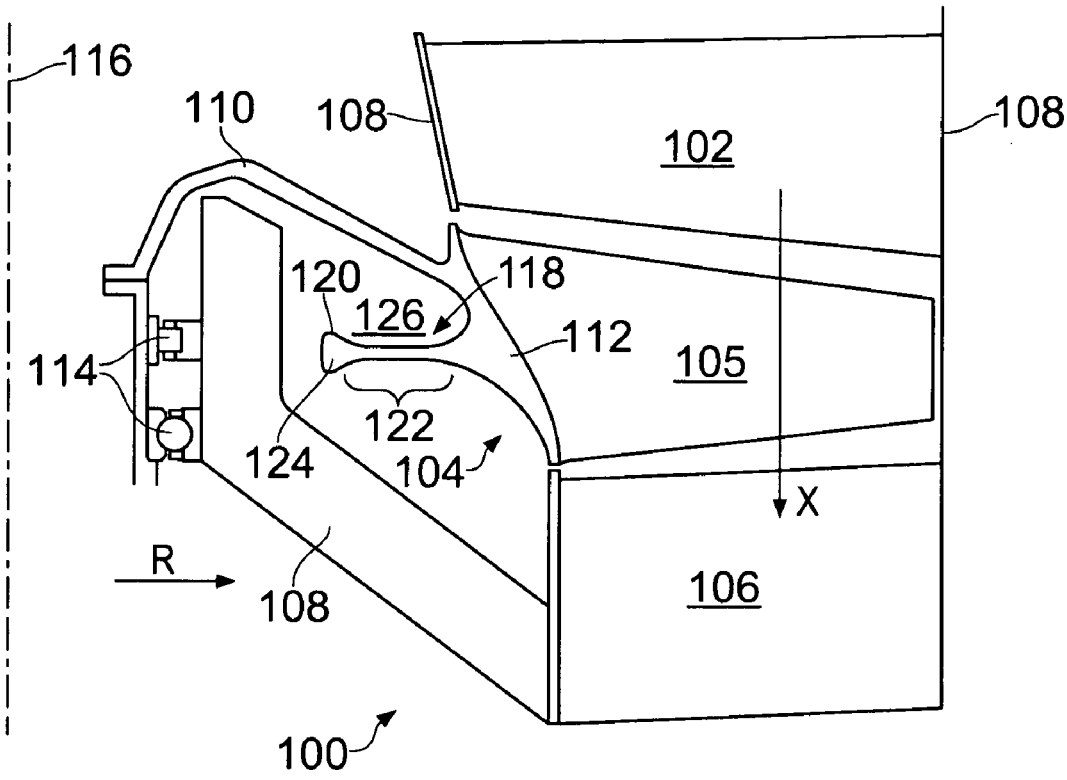
FIG. 1 is an axisymmetric section through a known disc with a contoured diaphragm.

Referring to FIG. 1, part of a fan 100 is shown including an upstream guide vane (or stator vane) arrangement 102, a fan blade (or rotor vane) arrangement 104 and a downstream guide vane (or stator vane) arrangement 106. The guide vane arrangements 102, 106 include a plurality of circumferentially spaced guide vanes and are mounted on a non-rotating structure 108 of the fan.

The fan blade arrangement 104 includes a plurality of circumferentially spaced fan blades 105 mounted on a disc 110. The disc 110 includes a land 112 from which the blades project radially. The blades 105 are integral with the disc 110 (known as a blisk). The fan blade arrangement 104 is rotationally mounted via bearings 114 to the non-rotating structure 108 of the fan. As such, the fan blade arrangement 104 can be rotated about a primary axis of rotation 116. When the fan blade arrangement 104 is rotated, fluid is drawn over the blades 105 in an axial flow direction X (also known as a downstream direction).

The disc 110 further includes a diaphragm 118 projecting radially from the region of the land 112 towards the primary axis of rotation 116. The diaphragm 118 extends from a free inner radius 120 to the area of the land 112 in a radial direction R, perpendicular to the primary axis of rotation 116.

The diaphragm 118 includes a web 122 of constant axial thickness and widens to a toe region 124 of substantially larger axial thickness than the web 122. The highest hoop stresses encountered in the diaphragm 118 are at the free inner radius 120 and as such the increased thickness of the toe region 124 is intended to reduce damage through this high stress.

The diaphragm 118 is conventionally manufactured symmetrically about a plane perpendicular to the primary axis of rotation 116. As such, the toe region 124 includes a projection in the −X (minus X) direction at the free inner radius 120. As such, a tub-like region 126 is created which, when the fan 100 is oriented vertically (as shown in FIG. 1), fluids become trapped in the tub-like region 126. Drainage holes (not shown) are commonly employed to alleviate this problem, but reduce component life.

Figure 2:
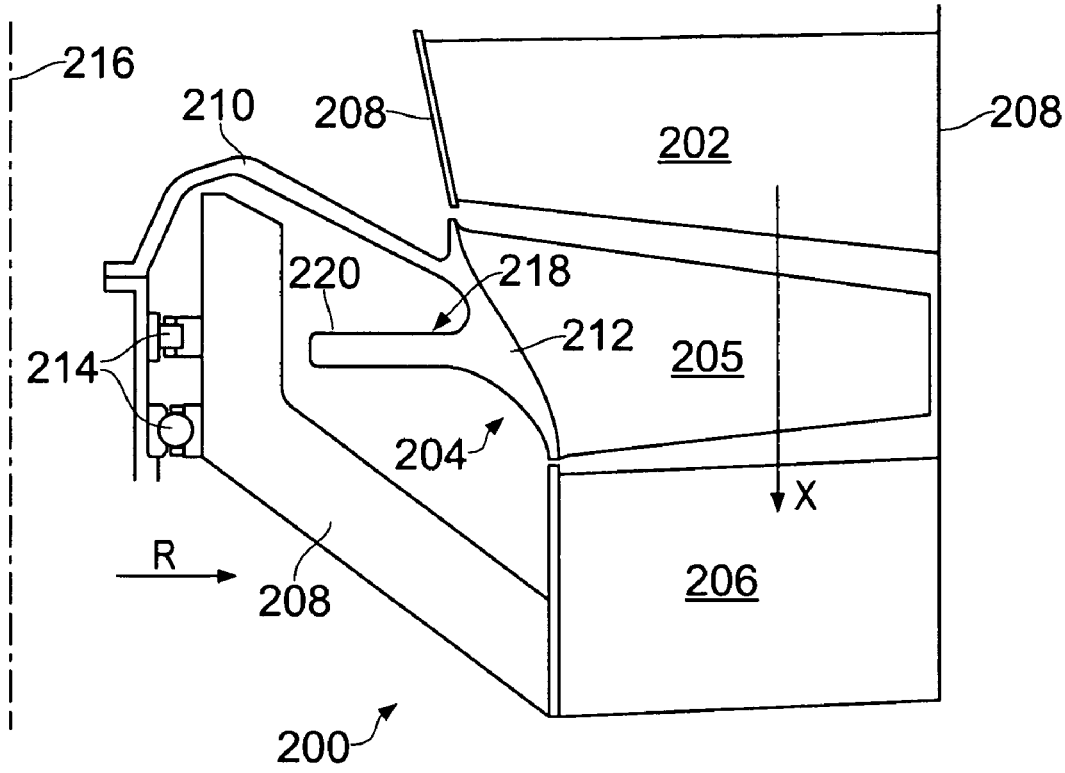
FIG. 2 is an axisymmetric section through a known slab-sided disc.

Referring to FIG. 2, reference numerals for similar components are as FIG. 1 but 100 greater. The diaphragm 218 is of constant axial thickness and as such no tub-like region is created. The disc 210 is known as a slab-sided disc. Fluid may flow over the inner free radius 220 and will alleviate the above problem. However, the diaphragm 218 must be as wide as necessary to cope with the maximum stress at the free inner radius 220 and as such the disc 210 is unnecessarily heavy.

Figure 3:
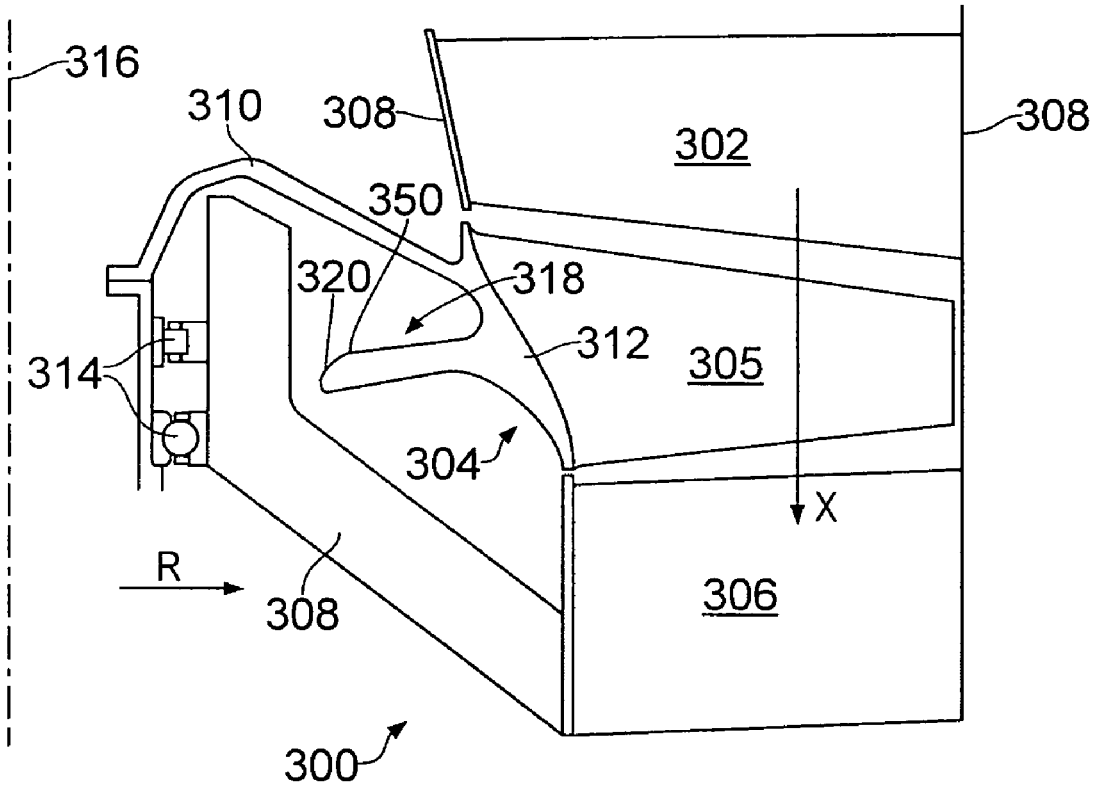
FIG. 3 is an axisymmetric section through a disc in accordance with a first embodiment of the present invention.

Referring to FIG. 3, reference numerals for similar components are as FIG. 1 but 200 greater. The fan 300, in accordance with the exemplary embodiments, has an asymmetric diaphragm 318, tilted in cross section to direction R and describing a frustrocone tapered in the an axial flow direction X.

It should be noted that the diaphragm 318 slopes towards its free inner radius 320 in the axial flow direction X. Therefore, if the fan 300 is orientated with the axial flow direction X vertical (e.g., as it would be in a propulsive fan and as shown in FIG. 3), any liquids present would run off the diaphragm in the X direction towards the primary axis of rotation 316 (i.e., in the −R direction).

This property of the diaphragm can be expressed by providing a radial co-ordinate R and an axial co-ordinate X for each position on a leading surface of the diaphragm 318 (i.e., the upper surface in FIG. 3) and designing the diaphragm 318 such that for all R coordinates $$\frac{dR}{dX} < 0.$$

In other words, the slope of the leading surface is always towards the primary axis of rotation 316 and in the axial flow direction X, thus preventing the creation of liquid traps or tubs. Therefore fluids can run off the diaphragm 318 to the free inner radius 320.

This property of the diaphragm can also be expressed by simply stating that the leading surface of the diaphragm always bends or curves in the axial flow direction X (i.e., the downstream direction).

The asymmetric shape of the diaphragm 318 causes bending stresses in the diaphragm due to the rotation about the primary rotation axis 316. These bending stresses act to alleviate the hoop stresses encountered throughout the diaphragm, and in particular at the free inner radius 320 where the hoop stresses are at a maximum. The hoop stress gradient across the diaphragm in the radial direction R is also reduced, and as such the material in a constant thickness diaphragm is used more effectively.

Therefore, the axial thickness of the diaphragm at the free inner radius 320 can be reduced, as can the axial thickness of the entire diaphragm 318, thus reducing weight over the slab sided disc 310.

The diaphragm also has a tapered region 350 proximate the free inner radius 320. The tapered region 350 results in a lower disc mass compared to a non-tapered diaphragm. Additionally, the taper reduces the peak hoop stresses seen at the inner radius 320 of the diaphragm 318.

Additionally, the substantially constant axial thickness of the diaphragm reduces thermal gradients in the radial direction, particularly during take off and landing which reduces thermo-mechanical stresses on the component.

Referring to FIGS. 4*a* to 4*e*, FIG. 4*a* shows the diaphragm 318 of the fan 300. A plane P is shown and is perpendicular to the primary rotation axis 316 (as shown in FIG. 3). In each of the FIGS. 4*b* to 4*e* the diaphragm 318 is shown in hidden line for comparison.

Referring to FIG. 4*b*, a similar diaphragm 418 is shown, but without the tapered region 350 of the diaphragm 318. Instead a region 450 is a 90 degree corner. Although the peak stresses are higher than those seen in the diaphragm 318, they are lower than those observed, for example, a slab-sided disc 200 due to the asymmetry of the diaphragm 418 introducing bending stresses during rotation.

FIG. 4*c* shows another diaphragm 518 whereby a slope angle S of a leading face 552 is greater than a slope angle of a trailing face 554 (which in this embodiment is substantially parallel to the plane P). The leading and trailing face angles do not have to be the same, or similar such that the diaphragm may taper in the radial direction.

Referring to FIG. 4*d*, the diaphragm 618 has a leading face 652 with a lesser slope angle than the trailing face 654 such that a different taper is seen to that of diaphragm 518. It will be noted that although the leading face 652 has a lower slope angle in this embodiment, no liquid traps are formed.

Referring to FIG. 4*e*, the diaphragm 718 is oriented to lean in the opposite direction to the diaphragm 318, i.e., the slope of the leading surface towards the primary axis of rotation 316 is opposite to the axial flow direction X. Although this would provide a structural benefit in reducing hoop stresses, this design would be less effective in reducing liquid traps. This design could be used in applications where liquid trapping is less of a problem (e.g., if the fan is horizontally orientated) and where packaging space availability prevents the use of the lean shown in diaphragm 318.

Referring to FIG. 4*f*, a similar diaphragm 818 is shown, but a tapered region 850 is provided as a single flat rather than a curved feature.

Referring to FIG. 4*g*, a similar diaphragm 918 is shown, but a tapered region 950 is provided as a curved feature approximated from a number of flats 952.

Variations are envisaged to fall within the scope of the present invention. For example the asymmetric diaphragm may not be of constant radial thickness, but may taper inwardly in the radial direction R. The trailing surface of the frustroconical surface of the asymmetric diaphragm may provide such a taper whilst maintaining the leading surface with $$\frac{dR}{dX} < 0$$

to encourage draining.

The diaphragm leading edge may also include "flat" or radially orientated areas such that $$\frac{dR}{dX} \leq 0$$

(e.g., as seen in diaphragm 618). This may be expressed by stating that the leading surface of the diaphragm does not bend or curve in the −X (i.e., upstream) direction.

The invention is also applicable to turbines and compressors as well as fans, both used in gas turbines and electrically powered applications. The invention could be equally applied to horizontally mounted fans, compressors and turbines.

The invention claimed is:

1. A turbomachinery disc comprising:

a disc body having a blade land defined thereon, the disc having a primary axis of rotation and an axial flow direction parallel to the primary axis of rotation; and a single annular diaphragm extending from proximate the blade land to a free inner radius, the diaphragm being asymmetrical about a plane perpendicular to the primary axis of rotation, in which the diaphragm defines a leading surface facing the axial flow direction, wherein the leading surface is sloped towards the primary axis of rotation in a downstream direction.

2. A turbomachinery disc according to claim 1 in which the diaphragm is of a substantially constant axial thickness in the radial direction.

3. A turbomachinery disc according to claim 1 in which the diaphragm is substantially a conical frustum.

4. A turbomachinery disc according to claim 3 in which the diaphragm comprises a tapered region at the free inner radius in the direction of the conical frustum surface.

5. A turbomachinery disc according to claim 3 in which the conical frustum generally tapers in the axial flow direction.

6. A turbomachinery disc according to claim 1 in which the turbomachinery disc is a gas turbine compressor or turbine disc.

7. A turbomachinery disc according to claim 1 in which the turbomachinery disc is a propulsive fan disc.

* * * * *